US008201593B2

(12) United States Patent
Conforti et al.

(10) Patent No.: US 8,201,593 B2
(45) Date of Patent: Jun. 19, 2012

(54) CONTROL UNIT FOR A FILLING HEAD

(75) Inventors: Lucio Conforti, Fornovo Taro (IT); Paolo Cavazzini, Parma (IT)

(73) Assignee: Sidel S.p.A., Parma (IT)

( * ) Notice: Subject to any disclaimer, the term of this patent is extended or adjusted under 35 U.S.C. 154(b) by 1031 days.

(21) Appl. No.: 11/991,803

(22) PCT Filed: Sep. 4, 2006

(86) PCT No.: PCT/EP2006/065980

§ 371 (c)(1),
(2), (4) Date: Jun. 23, 2008

(87) PCT Pub. No.: WO2007/031424

PCT Pub. Date: Mar. 22, 2007

(65) Prior Publication Data

US 2009/0038710 A1 Feb. 12, 2009

(30) Foreign Application Priority Data

Sep. 12, 2005 (IT) ..... MO2005A0229

(51) Int. Cl.
*B65B 3/04* (2006.01)

(52) U.S. Cl. ..... 141/192; 141/242; 141/392

(58) Field of Classification Search ..... 141/192, 141/237, 242, 392

See application file for complete search history.

(56) References Cited

U.S. PATENT DOCUMENTS

| | | | | |
|---|---|---|---|---|
| 3,633,635 | A * | 1/1972 | Kaiser | 141/40 |
| 4,386,635 | A * | 6/1983 | Ahlers et al. | 141/6 |
| 4,417,610 | A * | 11/1983 | Waldstrom et al. | 141/91 |
| 4,787,427 | A * | 11/1988 | Bacroix et al. | 141/39 |
| 4,982,768 | A * | 1/1991 | Ahlers | 141/6 |
| 5,000,234 | A * | 3/1991 | Weiss | 141/6 |
| 5,501,253 | A * | 3/1996 | Weiss | 141/40 |
| 5,564,481 | A * | 10/1996 | Clusserath | 141/92 |
| 5,634,500 | A * | 6/1997 | Clusserath et al. | 141/48 |
| 6,109,483 | A * | 8/2000 | Wilke et al. | 141/192 |
| 6,155,314 | A * | 12/2000 | Ding et al. | 141/285 |
| 6,179,016 | B1 * | 1/2001 | Neacker et al. | 141/39 |
| 6,601,618 | B2 * | 8/2003 | Tsukano et al. | 141/45 |
| 7,347,231 | B2 * | 3/2008 | Schmoll | 141/52 |

(Continued)

FOREIGN PATENT DOCUMENTS

DE 44 27 086 12/1994

(Continued)

OTHER PUBLICATIONS

Machine translation of DE 10000793, Aug. 2001, all pages.*

(Continued)

*Primary Examiner* — Gregory Huson
*Assistant Examiner* — Nicolas A Arnett
(74) *Attorney, Agent, or Firm* — Nixon & Vanderhye P.C.

(57) ABSTRACT

An apparatus comprising a body of a filling head provided with actuators controlled by a control logic unit, the control logic unit being mounted on the body, the body being provided with seats for the actuators and with further seats for receiving solenoid valves arranged for operating the opening and/or the closing of said actuators. The body comprises passages for electric connecting elements between the control logic unit and the actuators and/or the solenoid valves, the electric connecting elements comprising contact elements connected to the control logic unit.

14 Claims, 1 Drawing Sheet

U.S. PATENT DOCUMENTS

| | | | | |
|---|---|---|---|---|
| 7,353,848 | B2 * | 4/2008 | Krulitsch | 141/56 |
| 7,647,950 | B2 * | 1/2010 | Clusserath | 141/56 |
| 7,958,916 | B2 * | 6/2011 | Poole et al. | 141/83 |
| 7,958,917 | B2 * | 6/2011 | Conforti | 141/95 |
| 2004/0123917 | A1 * | 7/2004 | Crivellaro et al. | 141/83 |

FOREIGN PATENT DOCUMENTS

| | | | |
|---|---|---|---|
| DE | 196 12 797 | | 10/1996 |
| DE | 196 42 181 | | 4/1997 |
| DE | 100 00 793 | | 8/2001 |
| DE | 201 05 716 | | 5/2002 |
| WO | WO 99/14154 | * | 3/1999 |

OTHER PUBLICATIONS

International Search Report for PCT/EP2006/065500 mailed Nov. 11, 2006.

* cited by examiner

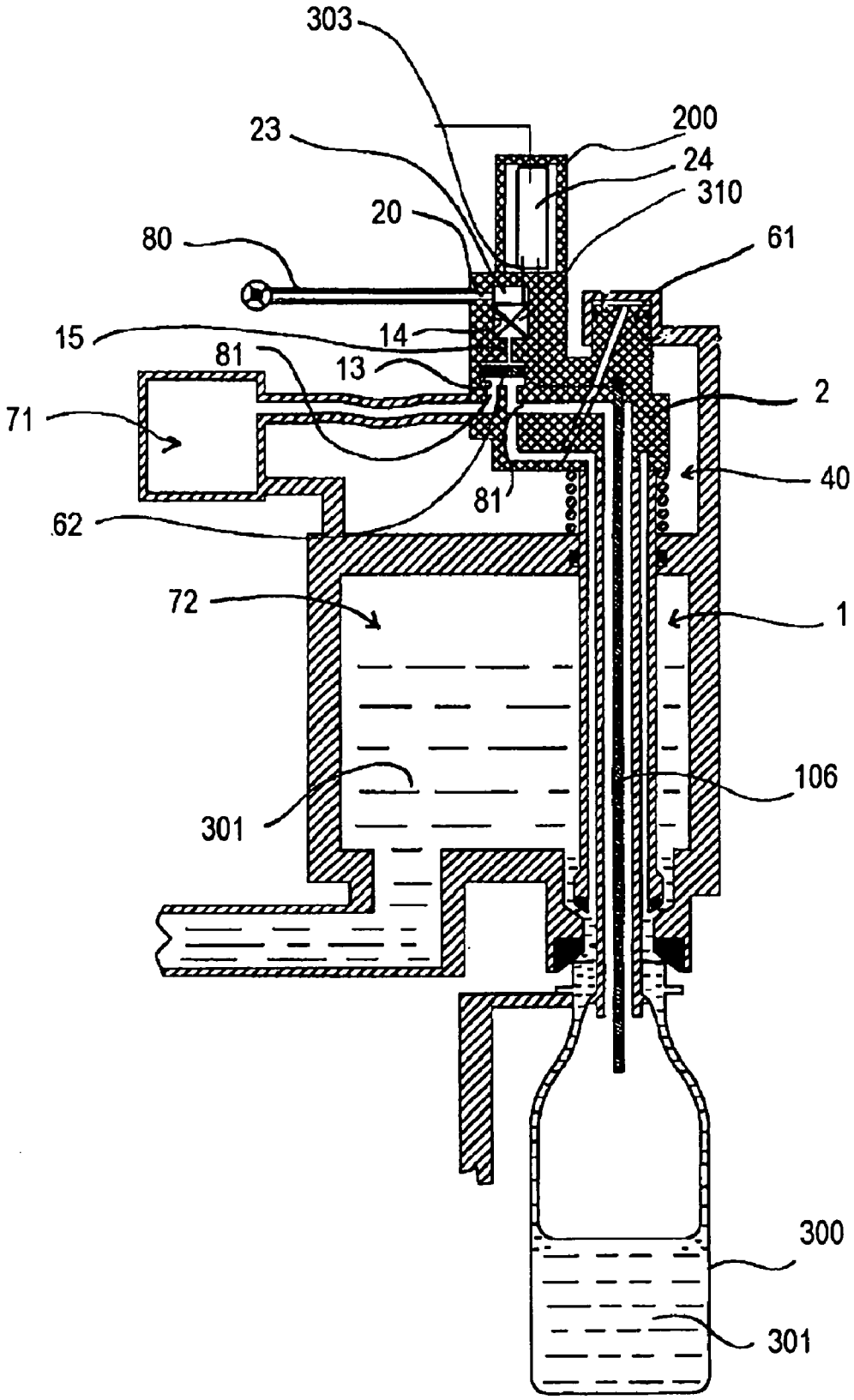
303
23
200
24
310
20
80
61
15
14
81
13
2
71
40
81
62
72
1
106
301
300
301

CONTROL UNIT FOR A FILLING HEAD

CROSS-REFERENCE TO RELATED APPLICATIONS

This application is the U.S. national phase of International Application No. PCT/EP2006/065980, filed 4 Sep. 2006, which designated the U.S. and claims priority to Italy Patent Application No. MO2005A000229, filed 12 Sep. 2005, the entire contents of each of which are hereby incorporated by reference.

BACKGROUND AND SUMMARY

The invention relates to filling heads for filling machines used in the bottling industry. In particular, the invention relates to filling heads arranged for filling containers.

Filling machines comprise a rotating carousel on which a plurality of filling heads are mounted, each one of which is arranged to fill a respective container.

Each filling head comprises a plurality of solenoid valves that drive actuators arranged to regulate at each filling step a flow of a filling product and a flow of a service fluid.

Filling heads are known comprising a box element positioned on the rotating carousel, above at a certain distance of, and substantially at each filling head.

The box element is designed for receiving a first electronic card and a plurality of solenoid valves connected to the first electronic card by means of electric cables.

The solenoid valves are controlled by the first electronic card and are arranged to drive actuators positioned on the filling heads.

This is possible by means of a plurality of pneumatic cables that connect each solenoid valve to a respective actuator.

The filling parameters and the control signals that are necessary for correctly operating the solenoid valves are gathered in a second electronic card that is positioned on the ground and that communicates the command signals to each first electronic card of a corresponding filling head by means of infrared-ray transmitting means.

A drawback of the known filling heads relates to the constructional complexity that entails great costs to be sustained for the purchase, installation and maintenance of the electric and the pneumatic cabling that is necessary for driving respectively the solenoid valves and the actuators.

In fact, such cabling is particularly costly and the assembly thereof requires a series of slow and laborious operations that entail a further increase of cost.

A further drawback relates to the significant length of the pneumatic cabling between solenoid valves and actuators.

This entails delays in the response times of the actuators with consequent difficulty in setting up the filling head.

An object of the invention is to improve the filling heads for filling machines.

A further object is to make filling heads that are easy to be made and have limited overall dimensions.

Another object is to obtain filling heads that have electric cabling and/or pneumatic cabling of particularly reduced dimensions with consequent money saving.

According to the invention, an apparatus is provided comprising a body of a filling head provided with actuators controlled by a control logic unit, said control logic unit being mounted on said body, said body being provided with seats for receiving solenoid valves arranged for operating the opening and/or the closing of said actuators, wherein said body comprises passages for electric connecting elements between said control logic unit and said actuators and/or said solenid valves, as the case may be, said electric connecting elements comprising electric contact elements connected to said control logic unit.

Owing to this aspect of the invention it is possible to obtain filling heads of limited cost. In fact, the filling heads according to the invention may incorporate possible solenoid valves arranged for controlling the actuators, the actuators, and conduits arranged for placing the solenoid valves in communication with the actuators.

In this way connecting cabling is no longer necessary.

This furthermore enables the filling head to have particularly reduced overall dimensions and to be easy to carry out.

BRIEF DESCRIPTION OF DRAWING

The invention can be better understood and implemented with reference to the attached drawing, which illustrates an embodiment thereof by way of non-limitative example, in which:

FIG. 1 is a longitudinal section of a filling head.

DETAILED DESCRIPTION

With reference to FIG. 1, there is shown a filling head 1 that is positionable on a rotating carousel, not shown, of a filling machine used in the bottling industry.

The filling head 1 enables beverage containers 300 to be filled.

The filling head 1 comprises an upper portion 40 on which a body 2 is removably mounted that defines first actuators 61.

The body 2 is provided with seats 13 each one of which receives a respective actuator and with further seats 14 each one of which receives a respective solenoid valve 310, each solenoid valve 310 is arranged for operating the opening and/or the closing of a corresponding actuator.

The seats 13 and the further seats 14 are connected through conduits 15, obtained in the body 2, said conduits 15 comprising conduits that are independent of one another and have a prevalently rectilinear extent.

The seats 13 are arranged for receiving second actuators 62.

The second actuators 62 have the function of regulating, in each filling phase, the flow and/or the downflow of an operating fluid.

The passage of the operating fluid contained in a second tank 71 to the bottle 300 occurs owing to passage conduits 81 obtained in the body 2 and controlled by the second actuators 62.

The body 2 furthermore comprises inlet conduits 20.

The inlet conduits 20 are arranged for receiving a control fluid, for example air, conveyed by a supplying tube 80, used by the solenoid valves to control the aforementioned actuators.

The inlet conduits 20 have a prevalently rectilinear extent and leads into a chamber 23 communicating in use with the further seats 14.

On the body 2 a further box element 200 is furthermore removably fixed in which there is positioned a control logic unit 24, for example an electronic card, arranged for operating the aforesaid solenoid valves.

The control logic unit 24 is positioned substantially above and in correspondence of the chamber 23 and communicates therewith by means of passages obtained in the body 2.

The passages are arranged for receiving electric connecting elements 303, for example contact elements, connected to the electronic card.

The contact elements are arranged for inserting itself into further contact elements, which are not shown, projecting above the aforesaid solenoid valves, so as to make a desired electric connection.

The position of the control logic unit 24, mounted on the body 2, makes the replacement thereof easy if this is necessary.

It should be noted that the small distance existing between the control unit 200 and therefore the electronic card 24 with respect to the solenoid valves enables to be used instead of electric cabling that is normally used in the known filling heads, contact elements, that in addition to being cheaper, has less probability of getting damaged and requires less maintenance than electric cabling and entails very little assembly time.

It should furthermore be noted that the filling head 1 according to the invention has particularly small overall dimensions, is compact and is totally devoid of external pneumatic cabling between the solenoid valves and the respective actuators, which are on the other hand connected together through the conduits 15 obtained in the body 2.

In addition to greatly simplifying the structure of the filling head 1, this enables the drawbacks to be eliminated that are typically connected with the use of pneumatic cabling, i.e. delayed response, high purchase and maintenance cost, need for repair in the event of damage.

The operation of the filling head 1 is disclosed briefly below.

The electronic card 24, also known as an electronic "slave" card, regulates the operation of the solenoid valves by dialoguing with a "master" electronic card, positioned on the ground and interfaced with a PLC and with an operator interface, as disclosed in WO99/14154.

The solenoid valves command in turn the operation of the actuators by suitably regulating the flow of the control fluid.

The actuators, for example pneumatic actuators, are driven by means of the pressure exerted by the control fluid on the latter, whilst the opening of the actuators can be achieved by means of preloaded springs that enable the actuators to be opened once the pressure exerted by the control fluid is interrupted.

In an alternative embodiment of the invention, which is not shown, the actuators are commanded directly by the control logic unit 24 and not by solenoid valves.

In this case, electromechanical or piezoelectric actuators can be used that are connected directly to the electronic card by means of further electric connecting elements.

Lastly, from the body 2, tubular elements 106 projects arranged for interacting with the filling product 301 contained in the tank 72 so as to introduce the latter into the bottle 300.

The invention claimed is:

1. An apparatus comprising a body of a filling head provided with actuators controlled by a control logic unit, said control logic unit being mounted on said body, said body being provided with seats for said actuators and with further seats for receiving solenoid valves arranged for operating the opening and/or the closing of said actuators, wherein said body comprises passages for electric connecting elements between said control logic unit and said actuators and/or said solenoid valves, as the case may be, said electric connecting elements comprising contact elements connected to said control logic unit.

2. The apparatus according to claim 1, wherein said electric connecting elements comprises further contact elements projecting above said solenoid valves.

3. The apparatus according to claim 1, wherein between said seats and said further seats there are interposed conduits arranged to enable a control fluid to interact with said actuators.

4. The apparatus according to claim 3, wherein said conduits are obtained in said body.

5. The apparatus according to claim 4, wherein said conduits comprises a plurality of conduits that are independent of one another.

6. The apparatus according to claim 1, wherein said actuators are of pneumatic type.

7. The apparatus according to claim 1, wherein said body is provided with inlet conduits leading into said further seats for receiving a control fluid of said actuators.

8. The apparatus according to claim 7, wherein said inlet conduits lead into a chamber communicating with said further seats.

9. The apparatus according to claim 1, wherein said actuators are commanded directly by said control logic unit.

10. The apparatus according to claim 9, wherein said actuators are selected directly from a group comprising electromechanical actuators and piezoelectric actuators.

11. The apparatus according to claim 1, wherein said control logic unit comprises an electronic card.

12. The apparatus according to claim 1, wherein said body comprises passage conduits on which said actuators act to enable or respectively prevent the passage of an operating fluid.

13. The apparatus according to claim 1, wherein from said body, tubular elements lead away arranged to interact with a product to be introduced into containers.

14. The apparatus according to claim 1, wherein the connecting elements are connected to the control logic unit for connecting the control logic unit to the actuators and/or the solenoid valves, without using cable connections or connecting cables.

* * * * *